US006868779B2

(12) United States Patent
Schrauwers

(10) Patent No.: US 6,868,779 B2
(45) Date of Patent: Mar. 22, 2005

(54) PRINTING CYLINDER SUPPORT UNIT WITH SUPPORT RING

(75) Inventor: Carolus Josephus Antonius Maria Schrauwers, Bergen (NL)

(73) Assignee: Stork Prints B.V. (NL)

( * ) Notice: Subject to any disclaimer, the term of this patent is extended or adjusted under 35 U.S.C. 154(b) by 0 days.

(21) Appl. No.: 10/702,569

(22) Filed: Nov. 6, 2003

(65) Prior Publication Data

US 2004/0089183 A1 May 13, 2004

(30) Foreign Application Priority Data

Nov. 8, 2002 (NL) ..... 1021874

(51) Int. Cl.[7] ..... B41F 15/38; B41F 13/44; B41F 13/21

(52) U.S. Cl. ..... 101/116; 101/127.1; 101/216

(58) Field of Search ..... 101/212, 216, 101/114, 116, 128.1, 127.1, 375, 376, 479, 480

(56) References Cited

U.S. PATENT DOCUMENTS 3,565,002 A * 2/1971 Boehm ..... 101/116
3,892,176 A * 7/1975 Van der Winden ..... 101/116
3,986,451 A * 10/1976 Zimmer ..... 101/127.1

FOREIGN PATENT DOCUMENTS

EP 0 864 421 A1 9/1998
WO WO 2004022339 A1 * 3/2004

* cited by examiner

*Primary Examiner*—Leslie J. Evanisko
(74) *Attorney, Agent, or Firm*—Hoffmann & Baron, LLP

(57) ABSTRACT

A printing-cylinder support unit has a support frame and supporting means which are mounted on the support frame and are designed to rotatably support one of a plurality of printing cylinders in a retaining position. The supporting means have at least three support elements for each axial end of a printing cylinder, which support elements are each designed to interact with a running surface of a bearing ring which is connected to the printing cylinder. One of the support elements has a support ring and suspension means, connecting the support ring to the support frame such that it can rotate about its axis. The support ring is provided on the inner side with a support-ring running surface, and the support ring is designed so that, in the retaining position, the support-ring running surface comes into contact with the running surface of the bearing ring.

5 Claims, 4 Drawing Sheets

PRINTING CYLINDER SUPPORT UNIT WITH SUPPORT RING

CROSS-REFERENCE TO RELATED APPLICATIONS

This application claims priority from Netherlands Patent Application 1021874, filed Nov. 8, 2002, which is incorporated herein by reference.

FIELD OF THE INVENTION

The invention relates to a printing cylinder support unit for a printing machine in accordance with the preamble of claim 1.

BACKGROUND OF THE INVENTION

A printing cylinder support unit of this type is known from EP 0 864 421 A1. This document discloses a printing machine with exchangeable ink-applicator means. A printing machine of this type comprises a plurality of printing units, wherein each printing unit performs a separate function in the overall printing process. Printing units of this type may be suitable for various different printing forms with different pattern repeat lengths and suitable for various printing techniques, such as rotary screen printing, intaglio printing, letter press printing and flexographic printing. A printing unit generally comprises a printing cylinder and ink-applicator means. In the operating state, the printing cylinder makes contact along a describing line on the surface of the cylinder, the contact line, with a substrate which is to be printed. Ink is applied via the ink-applicator means to the inner side, in the case of screen printing, and directly to the outer side, in the case of printing techniques other than screen printing, of the printing cylinder.

The printing cylinder rests rotatably at each of the two axial ends in a circumferential bearing system, comprising three support rollers which radially enclose a round bearing ring which is secured concentrically on the corresponding axial end of the printing cylinder. This position is known as the retaining position. One of the three rollers is situated at the location of the contact line. The other two rollers are situated at the other end of the bearing ring.

In the prior art, it is possible to exchange printing cylinders. The reason for changing a printing cylinder may be that a different pattern repeat length and/or a different printing pattern has to be printed. It is advantageous for a printing cylinder with a different diameter and/or printing image to be used for this purpose. A printing cylinder can also be changed in order to change the printing technique. To exchange a printing cylinder, it is possible for two support rollers to move outwards along a path which is diagrammatically indicated by arrows A in FIG. 11 of the above mentioned patent. It is known in practice that paths A of this type are produced, for example, on account of the support rollers being rotatably secured to pivot arms, it being possible for the pivot pin of each of the pivot arms in its entirety to be moved in rectilinear translation if appropriate.

The third support roller for the radial retaining is located at a fixed position, where this roller, in the retaining position, makes contact with the bearing ring at a reference point. In the operating state, this reference point is located at a fixed position with respect to the contact line. On account of the position of this fixed roller, printing cylinders which have different diameters nevertheless make contact with the substrate along the same contact line.

This known printing cylinder support unit has a significant drawback. In practice, it has been found that the presence of a fixed support roller at the location of the reference point constitutes a serious restriction in terms of allowing the known support unit to be used in printing machines which do not take account of this fixed support roller and in which there is insufficient space for a fixed roller of this nature. The known support unit cannot then be used.

SUMMARY OF THE INVENTION

The object of the present invention is to provide a printing cylinder support unit in which these drawbacks are at least partially overcome or to create a useable alternative.

In particular, it is an object of the invention to provide a support unit which allows printing cylinders of different diameters and for different printing methods to be exchanged quickly and easily and which requires little space at the location of the reference point.

According to the invention, this object is achieved by a printing cylinder support unit in accordance with claim 1. This support unit comprises a support frame with supporting means. The supporting means are designed, in a retaining position, to rotatably support a printing cylinder at both axial ends. The supporting means are suitable for receiving printing cylinders of different diameters. A bearing ring is concentrically connected to each axial end of a printing cylinder which is suitable for the support unit. These bearing rings may form an integral unit with the printing cylinder or may be attached to the printing cylinder by means of a connection or joining method, such as a shrink-fit connection, an adhesively bonded connection or a connection using securing means. The supporting means comprise at least three support elements for each axial end. These support elements are designed to interact, in the retaining position, with the running surface of the bearing ring which is concentrically connected to the corresponding end of the printing cylinder, in such a manner that the support elements radially enclose the printing cylinder. One of the support elements comprises a support ring and suspension means. The suspension means connect the support ring to the support frame in such a manner that the support ring can rotate about its axis. The support ring comprises a running surface on its inner side, i.e. the side which faces towards the axis. The bearing ring can rest and roll in this running surface of the support ring. The internal diameter of the support ring is greater than the external diameter of the bearing ring associated with the largest printing cylinders for which the support unit is intended. Since the support ring takes up less space than a bearing roller according to the prior art, it is possible—as a result of the support ring being used at the location of the reference point—for the support unit to be used in printing machines which have only a limited amount of space available here. An additional advantage of the support unit according to the invention is that the printing cylinder can rest in the support ring before and after being exchanged, even if the other support elements do not enclose the running surface of the bearing ring. The printing cylinder can advantageously be changed through one of the support rings in this case.

In a preferred embodiment, the suspension means comprise running rollers for rotatably connecting the support ring to the support frame. The running rollers position the support ring and transmit forces which the printing cylinder exerts on the support ring to the support frame.

In a variant, the suspension means comprise an annular bearing. The annular bearing comprises an inner race and an outer race, which are concentric with respect to one another. The outer race is connected to the support frame. The inner race is concentrically connected to the support ring. In an alternative to this, it is also possible for the inner race itself to fulfill the function of the support ring.

In a preferred embodiment, the suspension means comprise springs which are designed to exert a force on the bearing ring via the support ring. The direction of this force is axial with respect to the bearing ring. The direction of the force faces away from the axial end of the printing cylinder. In this way, the support ring contributes to clamping the printing cylinder in place.

Finally, the invention relates to a printing machine provided with a printing cylinder support unit according to the invention.

BRIEF DESCRIPTION OF THE DRAWINGS

The principle and a preferred embodiment of the invention will be explained in more detail with reference to the appended drawings, in which.

DESCRIPTION OF THE PREFERRED EMBODIMENTS

Figure 1:
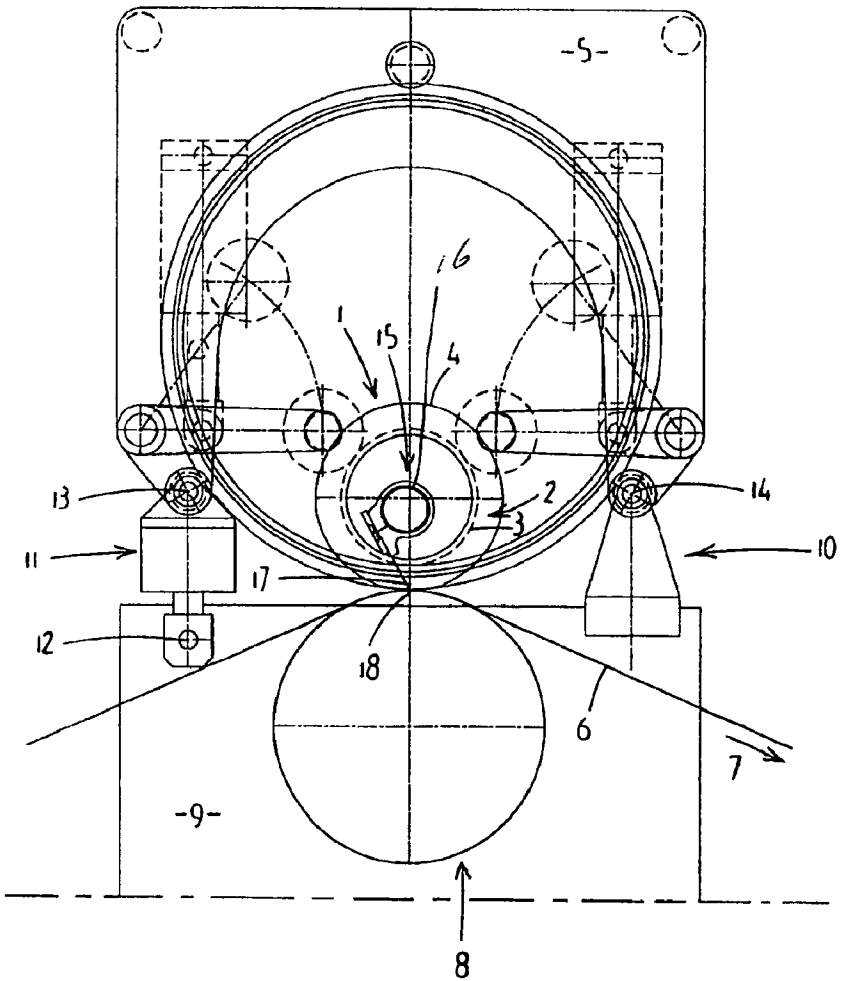
FIG. 1 shows a side view of a first preferred embodiment of the invention interacting with a counter-pressure roll of a printing machine.

All the figures show a printing cylinder 1 with a bearing ring 2 which has a running surface 3. A stencil 4 is clamped between the bearing rings 2 and is indicated in the cross-sectional views, purely as an indicative measure, by a dot-dashed line. The printing cylinder 1 is suspended rotatably from a support frame 5. FIG. 1 shows the printing cylinder support unit in accordance with a first preferred embodiment in the operating state used for rotary screen printing. The stencil 4 prints a substrate 6 which is passed through between the printing cylinder 1 and a counter-pressure roll 8 in the direction indicated by arrow 7. The counter-pressure roll 8 is connected to the machine frame 9, only part of which is shown in FIG. 1, by means of bearing means (not shown) in such a manner that it can rotate about its axis. The support frame 5, with the printing cylinder 1 connected to it, is rotatably connected to the machine frame 9 by means of a hinged joint 10 and an air cylinder 11. The air cylinder 11 is connected via a rotation point 12 to the machine frame 9 and via a rotation point 13 of the support frame 5. To move the printing machine out of the operating state shown, the air cylinder moves the support frame 5 away from the machine frame 9, with the support frame 5 rotating about the rotation point 14 of the hinge joint 10.

In the operating state shown, ink means are applied to the inner side of the stencil 4 by means of a squeegee 15. The squeegee 15 comprises a carrying tube 16, through which the ink means are supplied, and a squeegee blade 17 which extends as far as a printing point 18.

The printing cylinder 1 is suspended from the support frame 5 via various support elements 20, 30. The first support element is a support ring 20 in which the bearing ring 2 rests in such a manner that it can roll. The support ring 20 itself is suspended rotatably between running rollers 21 which in turn are secured to the support frame 5 in such a manner that they can rotate about their pin 22. This rotatable securing may be provided with spring means 23 which exert a force in the axial direction of the axes 22. These forces are transmitted via the support ring 20 to the bearing ring 2 and are used to axially clamp the stencil 4. The support ring 20 has an inner running surface 25 which, at a reference point 26, interacts with the running surface 3 of the bearing ring 2. The support ring 20 also has an inclined running surface 27 for axially clamping the stencil 4 via the bearing ring 2. Finally, the support ring 20 has an outer running surface 28, which interacts with the running rollers 21.

The second and third retaining elements are the bearing rollers 30. These bearing rollers are connected to arms 32 in such a manner that they can rotate about their pin 31. The arms 32 each pivot about a pin 33, the pins 33 being coupled on the left-hand and right-hand side of the printing cylinder by means of a synchronizing rod 34. The arms 32 can be moved by means of air cylinders 35 which are coupled to the synchronizing rod 34 via plunger rods 36 and coupling pieces 37.

Figure 2:
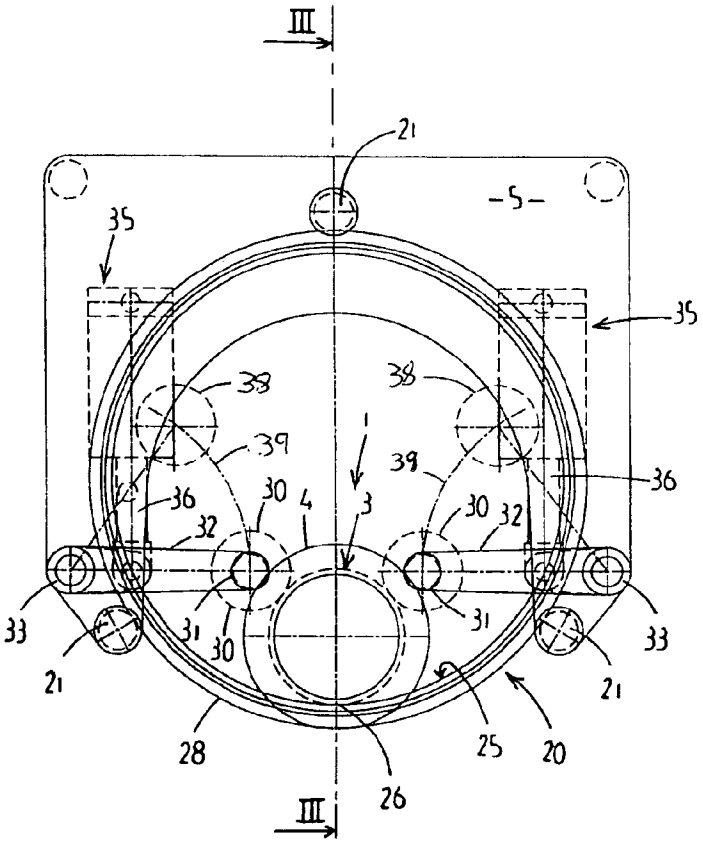
FIG. 2 shows a partial representation of FIG. 1.
Figure 3:
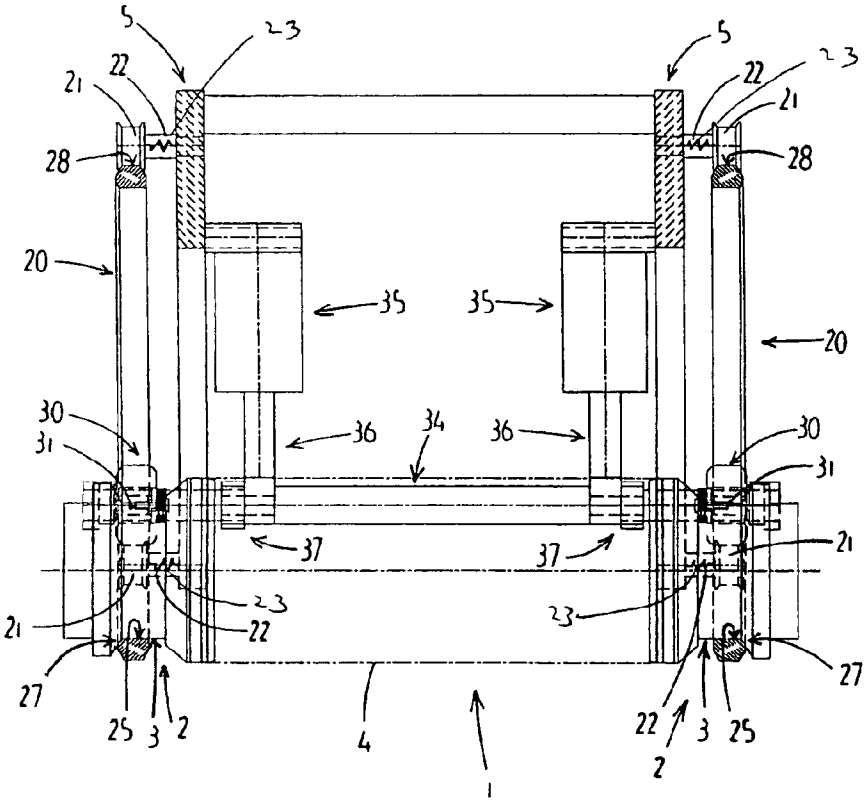
FIG. 3 shows a cross-sectional view on line III—III in FIG. 2.

A printing cylinder 1 is changed in the following way. The air cylinders 35 move the arms 32 towards an uppermost position 38, which is indicated by dashed lines for the bearing rollers 30 in FIG. 2, along a line 39. Then, the printing cylinder 1 can be removed and replaced with a different printing cylinder 1 which may have a different diameter. The printing cylinder 1 is placed into the support rings 20 by means of its bearing rings 2. Then, the arms 32 move back until the bearing rollers 30 press against the running surface 3 of the bearing rings 2. This once again produces a retaining position.

Figure 4:
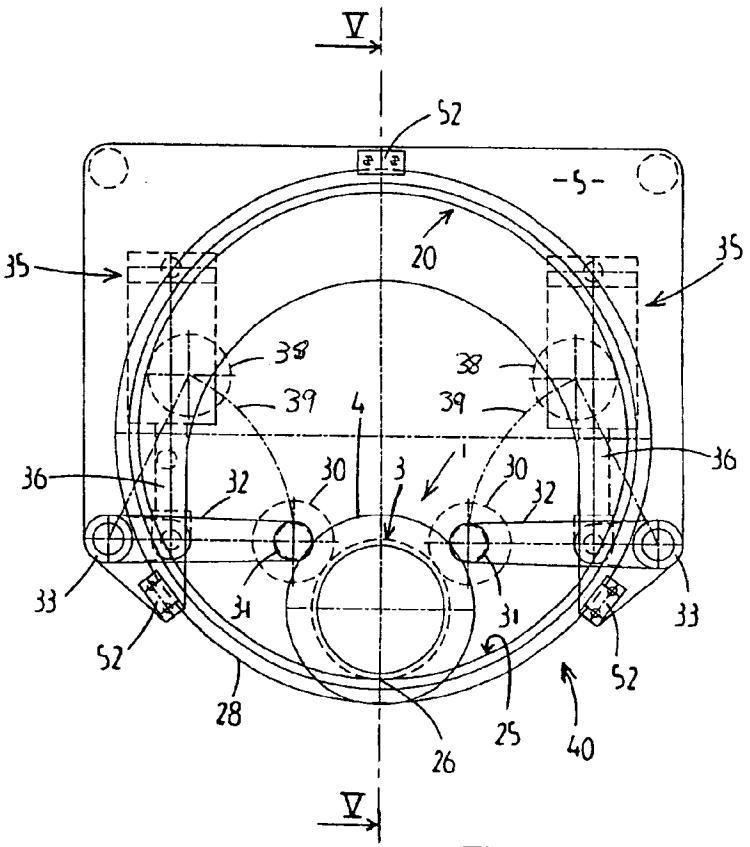
FIG. 4 shows a side view of a second preferred embodiment.
Figure 5:
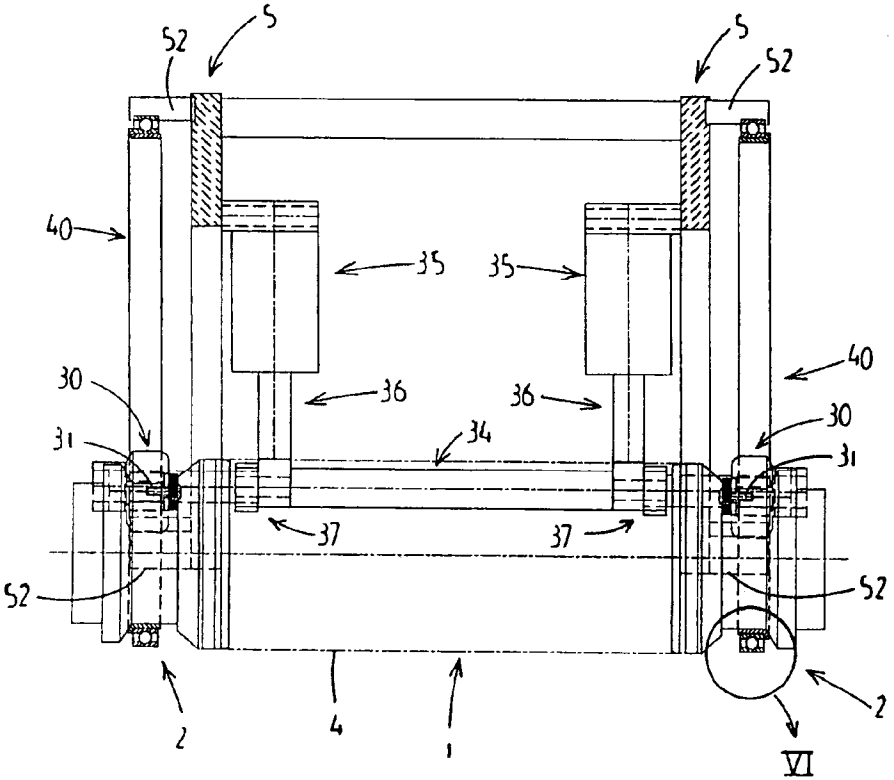
FIG. 5 shows a cross-sectional view on line V—V in FIG. 4.
Figure 6:
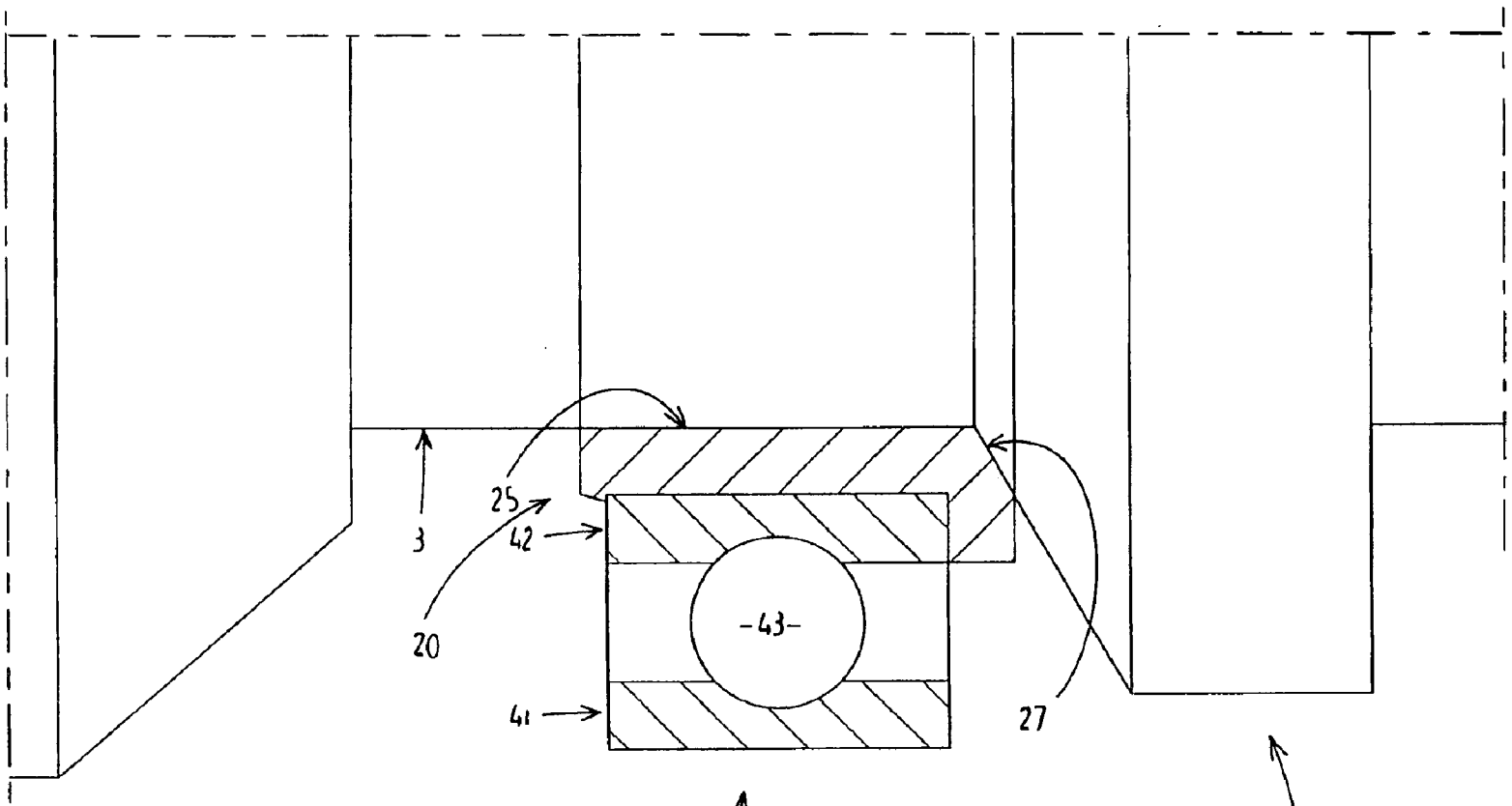
FIG. 6 shows a detail VI from FIG. 5 on an enlarged scale.

A second embodiment is shown in FIGS. 4 and 5, in which identical reference numerals denote the same components as in the first preferred embodiment. Unlike in the above embodiment, the support ring 20 is secured rotatably to the support frame 5 via an annular bearing 40. This annular bearing 40 is shown in more detail in FIG. 6, which shows an outer race 41 and an inner race 42, which can move with respect to one another on account of balls 43. A plastic annular component, which together with the inner race 42 forms the support ring 20 with running surfaces 25 and 27, is fixedly connected to the inner race 42. The outer race 41 of the annular bearing is connected to the support frame by means of three connecting pieces 52.

In all the drawings, it can be seen that the height of the support ring, which in the first preferred embodiment is the difference between the inner running surface 25 and the outer running surface 28 and in the second preferred embodiment is the difference between the inner running surface 25 and the outermost radius of the outer race 41, is designed to be so small that the support ring 20 takes up scarcely any space at the location of the reference point 26 and, for example, at this point projects no further beyond the support unit in the direction of the counter-pressure roll 8 than the outermost boundary of the printing cylinder 1.

In addition to the preferred embodiments shown and described above, numerous other designs and variants are possible. For example, there may be more or fewer than three running rollers. It is also possible for one or more of the running rollers to support the support ring on the inner side instead of on the outer side. It is even conceivable for one running roller to support the support ring from the inner side, diametrically with respect to the reference point.

Within the context of the invention, it is also possible to use different support elements from the illustrated configuration with bearing rollers. The bearing rollers may adopt a different position along the circumference of the bearing ring, and could even support this bearing ring from the inner side. Furthermore, the bearing rollers can move away from and towards the bearing ring via other mechanisms in order to enclose the bearing ring, for example by means of a rectilinear guide combined with a pressure cylinder. It would also be possible for the bearing rollers themselves to be replaced with, for example, sliding-contact bearings.

Finally, the axial clamping of the printing cylinder may also be affected in a different way, for example with the aid of additional bearing rollers which engage on the inclined side of the running surface of the bearing ring. In this case, the support ring does not have to perform any axial clamping function.

To summarize, the invention provides a support unit for a printing cylinder which is eminently suitable for exchangeable printing cylinders, can be used in printing machines where there is little space available, makes it possible to introduce a printing cylinder into the support unit at the correct position, is not only responsible for the radial retaining of the printing cylinder but also can effect axial clamping of the printing cylinder, and finally is relatively easy and therefore inexpensive to implement.

What is claimed is:

1. Printing-cylinder support unit for a printing machine, comprising a support frame and supporting means which are mounted on said support frame and are designed to rotatably support one of a plurality of printing cylinders in a retaining position, it being possible for said printing cylinders to have different diameters, and said supporting means comprising at least three support elements for each axial end of a printing cylinder, which support elements are each designed, in the retaining position, to interact with a running surface of a bearing ring which is concentrically connected to the corresponding end of the printing cylinder, wherein one of said support elements comprises a support ring and suspension means, said suspension means connect said support ring to said support frame in such a manner that said support ring can rotate about its axis, said support ring is provided on the inner side with a support-ring running surface, the internal diameter of said support ring is greater than the external diameter of said bearing ring of each of said printing cylinders, and said support ring is designed so that, in the retaining position, said support-ring running surface comes into contact with the running surface of said bearing ring.

2. Printing cylinder support unit according to claim 1, in which said suspension means comprise running rollers for rotatably connecting said support ring to said support frame.

3. Printing cylinder support unit according to claim 1, in which said suspension means comprise an annular bearing which comprises an inner race and an outer race which can rotate concentrically with respect to one another, said outer race being connected to said support frame while said inner race is concentrically connected to said support ring or forms an integral unit therewith.

4. Printing cylinder support unit according to claim 1, in which said suspension means comprise springs which are designed to exert a force on said bearing ring, via said support ring, in the axial direction of said bearing ring.

5. Printing machine, provided with a printing cylinder support unit according to claim 1.

* * * * *